US006003946A

United States Patent [19]

Jackson

[11] Patent Number: 6,003,946

[45] Date of Patent: Dec. 21, 1999

[54] CHAIR HAVING RECLINABLE BACK

[76] Inventor: Andrew W. Jackson, 255 Midland Rd., Clarendon Hills, Ill. 60514

[21] Appl. No.: 09/039,696

[22] Filed: Mar. 16, 1998

[51] Int. Cl.[6] ..... B60N 2/02

[52] U.S. Cl. ..... 297/377; 297/374

[58] Field of Search ..... 297/377, 354.12, 297/354.1, 374, 452.63

[56] References Cited

U.S. PATENT DOCUMENTS

| | | |
|---|---|---|
| 514,403 | 2/1894 | Allen . |
| 1,215,609 | 2/1917 | Arnold . |
| 2,182,516 | 12/1939 | Coble . |

FOREIGN PATENT DOCUMENTS

| | | | |
|---|---|---|---|
| 72958 | 9/1960 | France | 297/377 |
| 2625084 | 6/1989 | France | 297/377 |
| 195605 | 2/1938 | Switzerland | 297/377 |

OTHER PUBLICATIONS

Picture "A", showing chair with reclining back, admitted prior art.

Picture "B", showing chair with fixed back, admitted prior art.

*Primary Examiner*—Milton Nelson, Jr.

*Attorney, Agent, or Firm*—Rockey, Milnamow, & Katz, Ltd.

[57] ABSTRACT

In a chair having a frame, a fixed seat, and a pivotal back, the frame includes two bridge-supporting legs extending between an upper position and a lower position behind and below the upper position. A transverse bridge fitting removably into openings in the bridge-supporting legs bridges the bridge-supporting legs in at least two orientations. The bridge limits pivotal movement of the back, when pivoted downwardly and backwardly, to at least two reclined positions. In one contemplated embodiment wherein the transverse bridge comprises a beam fitting removably and non-rotatably into the openings and bridging the bridge-supporting legs in two such orientations, a spacer extending along and mounted fixedly to the transverse beam is interposed between the transverse beam and the back in one such orientation but not in the other orientation. In other contemplated embodiments wherein the transverse bridge comprises a transverse axle, similar spacers mounted fixedly to the transverse beam are interposed between the transverse beam and the back, each spacer having a bearing surface conforming generally to a spiral or to a closed, curved shape when viewed axially and adapted to bear against the back at varying radial distances from the axis.

6 Claims, 4 Drawing Sheets

CHAIR HAVING RECLINABLE BACK

TECHNICAL FIELD OF THE INVENTION

This invention pertains to an improved chair, which may be an Adirondack chair, with a reclinable back. According to this invention, an improved mechanism is provided, which limits pivotal movement of the reclinable back to any one of plural reclined positions. Although the improved chair including the improved mechanism can be predominantly made from wooden pieces, other materials can be alternatively employed, such as polymeric materials.

BACKGROUND OF THE INVENTION

Typically, apart from cushions if used, an Adirondack chair is made predominantly from wooden boards and other wooden pieces or from synthetic materials, such as polymeric materials. Typically, such a chair has a fixed seat. It is known for such a chair to have a reclinable back and a simple mechanism to enable the reclinable back to pivot downwardly and backwardly, either between an upright position and a reclining position or between an upright position and a selected one of two or more reclining positions. This invention has resulted from efforts to improve such a mechanism for an Adirondack chair.

SUMMARY OF THE INVENTION

This invention provides a chair comprising a frame, a seat mounted fixedly to the frame, and a reclinable back. At its lower end, the chair back is mounted pivotally to the chair frame, behind a back edge of the chair seat. An improved mechanism is provided, which limits pivotal movement of the reclinable back to any one of plural reclined positions.

The chair frame includes two bridge-supporting legs, each extending between an upper end and a lower end behind and below the upper end. Being located on a respective side of the chair, each bridge-supporting member has an opening. A transverse bridge is provided, which can be removably fitted into the openings so as to bridge the bridge-supporting legs in any one of at least two orientations. The bridge is configured so as to limit pivotal movement of the chair back, when pivoted downwardly and backwardly, to any one of at least two reclined positions of the chair back, specifically to one reclined position in each such orientation of the bridge.

In one contemplated embodiment, the elongate bridge comprises a transverse beam and at least one spacer. The beam is fittable removably and nonrotatably into the openings so as to bridge the bridge-supporting legs in either of two such orientations. Being mounted fixedly to the elongate beam, the spacer is interposed between the elongate beam and the chair back in one such orientation but not in the other orientation. Preferably, the spacer is elongate and extends along the beam.

In other contemplated embodiments, the elongate bridge comprises a transverse axle and at least one spacer. The axle is fittable removably and rotatably into the openings so as to bridge the bridge-supporting legs. Being mounted fixedly to the beam, the spacer is interposed between the elongate beam and the chair back. Further, the spacer has a bearing surface adapted to bear against the chair back at varying radial distances from the axis. The varying radial distances correspond to varying locations on the bearing surface.

In the contemplated embodiments mentioned in the preceding paragraph, the bearing surface, when viewed axially, defines a spiral, such as an Archimedean spiral, or conforms generally to a closed, curved shape, such as an eccentric circle or an ellipse.

Preferably, in any contemplated embodiment, each opening is a notch in the supporting leg having such opening and each notch opens upwardly and backwardly. Preferably, in each supporting leg, the notch is one of plural similar notches in such supporting leg. Preferably, a cleat attached to the back is positioned so as to overlie a portion of the transverse bridge so as to prevent the transverse bridge from lifting from the notches receiving the transverse bridge unless the chair back is tilted forwardly.

Although this invention has been made with a view toward its embodiment in Adirondack chairs made predominantly from wooden boards and other wooden pieces, apart from cushions if used, this invention may be also embodied in chairs made from other materials, such as polymeric materials.

These and other objects, features, and advantages of this invention are evident from the following description of the preferred and certain other embodiments of this invention.

DETAILED DESCRIPTION OF THE ILLUSTRATED EMBODIMENTS

Figure 1:
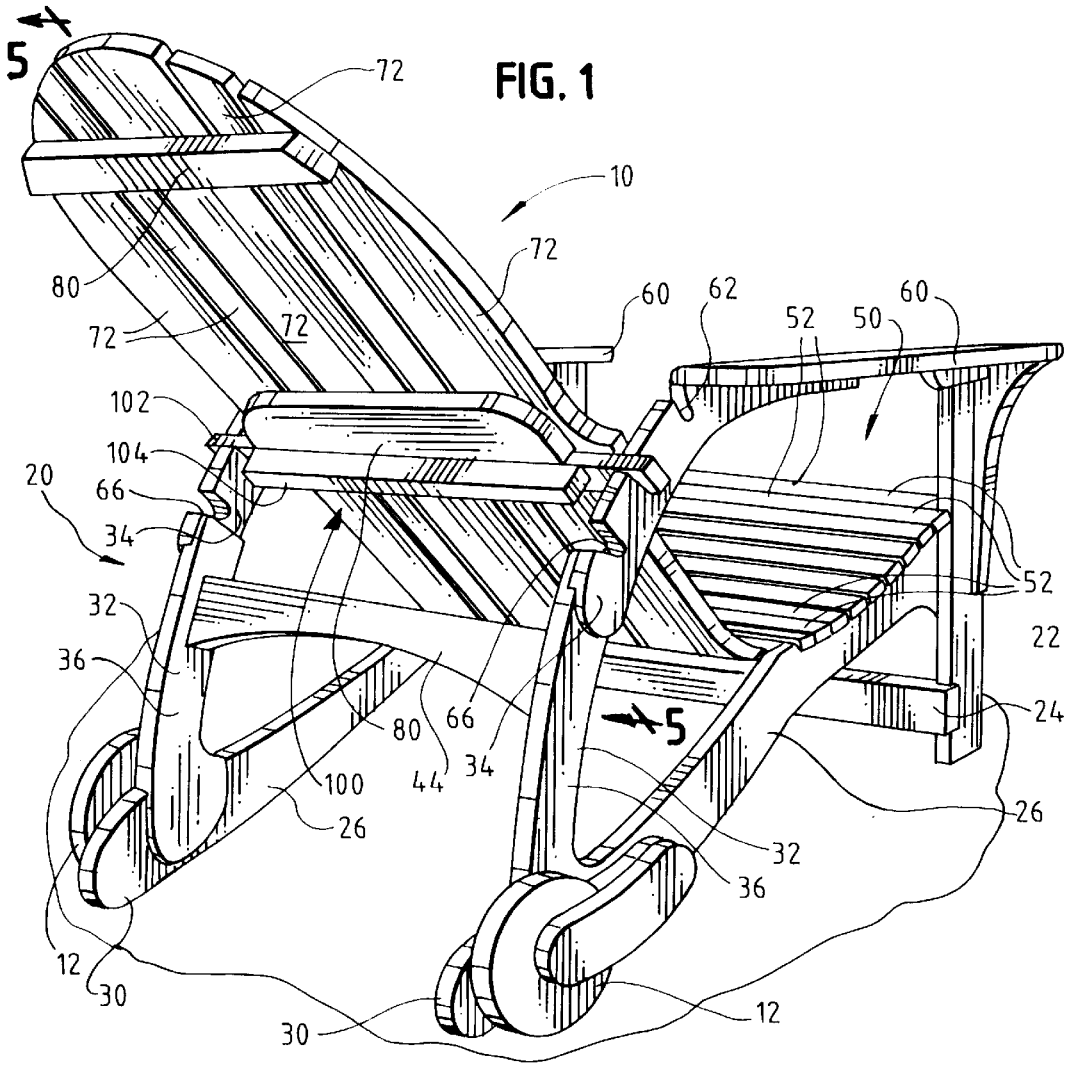
FIG. 1 is a perspective view of a chair comprising a reclining back and constituting a preferred embodiment of this invention, as taken from a side and rear vantage.
Figure 2:
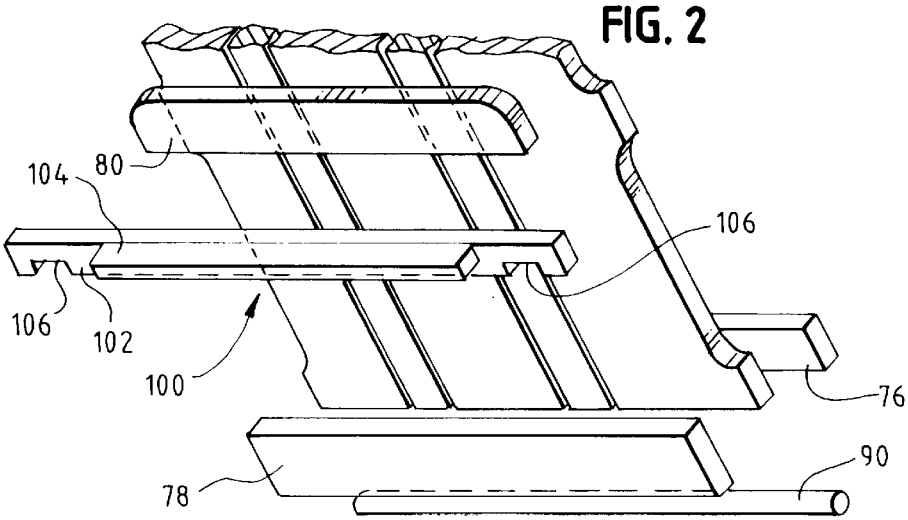
FIG. 2 is an enlarged, partly exploded detail of the chair, as shown in FIG. 1.
Figure 3:
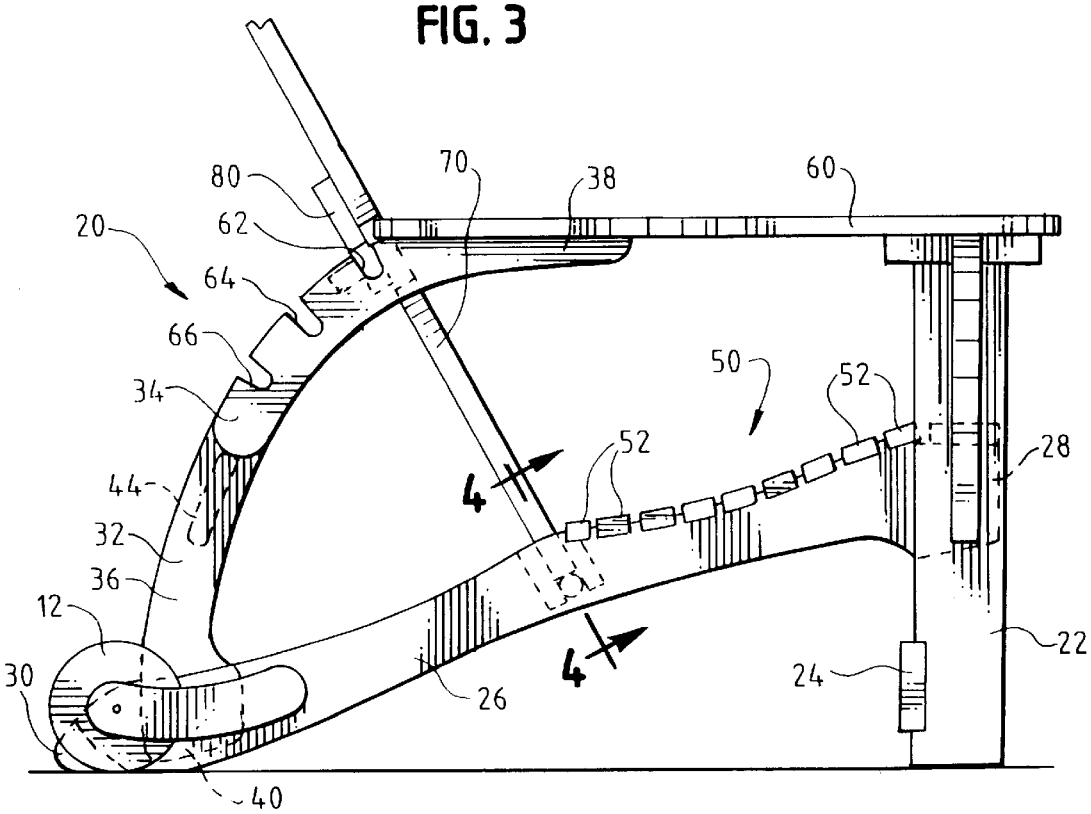
FIG. 3 is an elevational view of one side of the chair, as shown in FIG. 1, the other side being a mirror image of the side that is shown.
Figure 4:
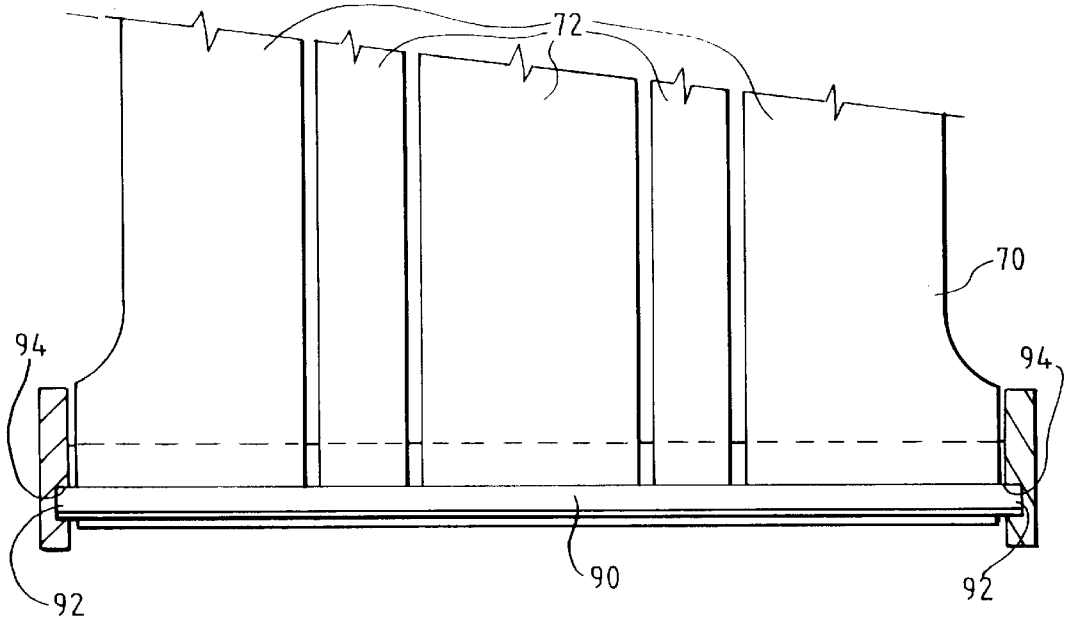
FIG. 4 is a sectional view taken along line 4—4 of FIG. 3, in a direction indicated by arrows.
Figure 5:
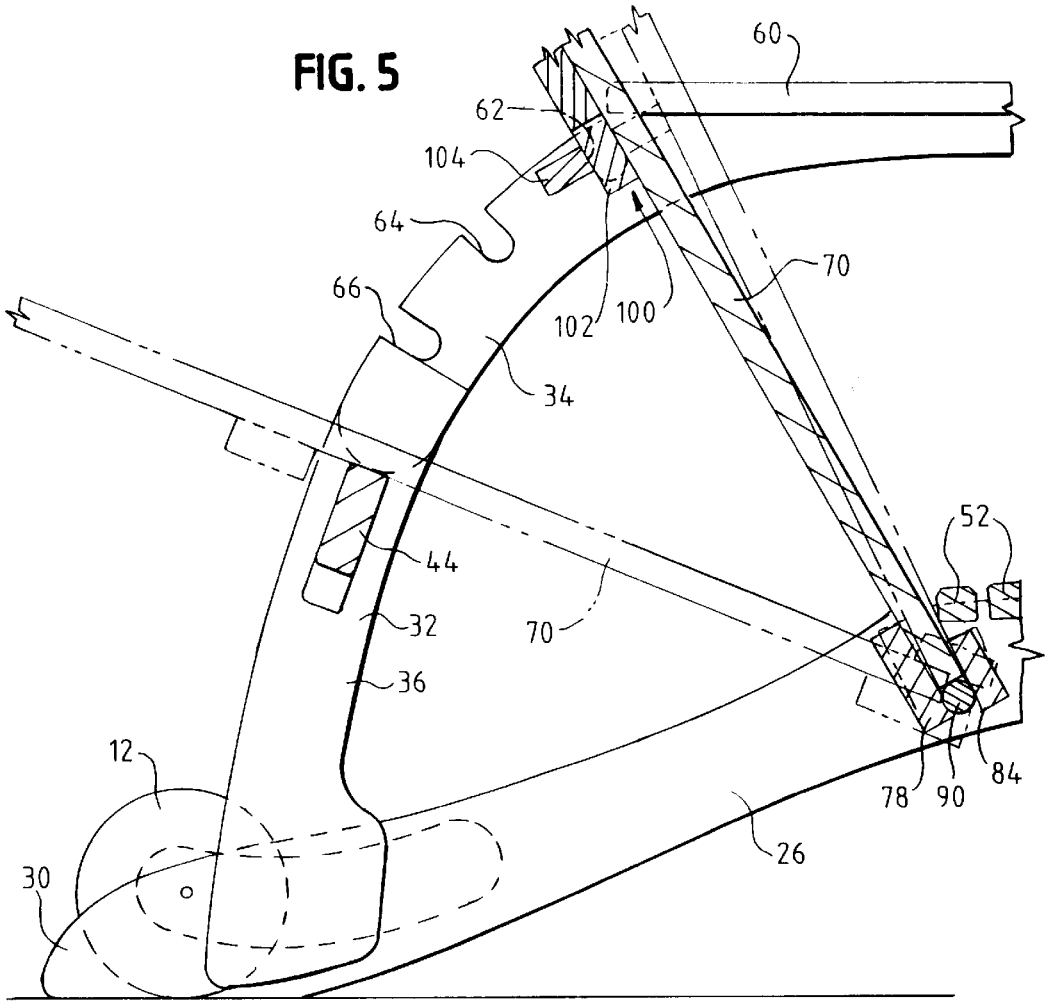
FIG. 5, 6, and 7 are fragmentary details of the chair, as shown in FIG. 1 but with the chair back shown in other reclining positions.

As shown in FIG. 1 and other views, a chair 10 of a type known as an Adirondack chair and made predominantly from wooden boards, such as mahogany boards, constitutes the preferred embodiment of this invention. Broadly, the chair 10 comprises a frame 20 assembled from wooden boards, a seat 50 comprised of individual slats 42, and a back 70, which is reclinable to a selected one of seven reclined positions. These reclined positions include an uppermost position, in which the chair back 60 is shown in FIGS. 1 and 3, and a lowermost position, in which the chair back 60 is shown in FIG. 5.

The chair frame 20 comprises two front legs 22, one at each side of the chair 10, a rigid brace 24 extending between the front legs 22 and attached via screws to the front legs 22, two longitudinal struts 26, one at each side of the chair 10, each extending backwardly and downwardly from the front leg 22 at the same side of the chair 10 and each having an upper end 28 attached via screws to such leg 22 and a lower end 30 behind and below the upper end 28. At the lower end 30, at each side of the chair 10, a wheel 12 is mounted operatively. The slats 52 of the chair seat 50 extend between the longitudinal struts 26 and are attached via screws to the longitudinal struts 26.

The chair frame 20 further comprises two supporting legs 32, one at each side of the chair 10, each being made of two pieces attached to each other via screws, namely an upper piece 34 and a lower piece 36, and each extending between an upper end 38 and a lower end 40 behind and below the upper end 36. The lower end 40 is attached via screws to the lower end 30 of the chair seat-longitudinal strut 26 at the same side of the chair 10. At an elevation between the upper and lower ends 38, 40, the chair frame 20 further comprises a rigid brace 44 extending between and attached via screws to the supporting legs 32.

The chair frame 20 further comprises two arms 60, one at each side of the chair 10. Each arm 60 extends between and is attached via screws to the front leg 22 at the same side of the chair 10 and to the upper piece 34 of the supporting leg 32 at the same side of the chair 10. As described so far, the chair frame 20, the wheels 30, the chair seat 50, and the arms 60 are conventional and are assembled conventionally.

As contemplated by this invention, at each side of the chair 10, the upper piece 34 of the supporting leg 32 is notched so as to define an upper notch 62, an intermediate notch 64, and a lower notch 66. At both sides of the chair 10, the upper notches 62 are aligned with each other, the intermediate notches 64 are aligned with each other, and the lower notches 66 are aligned with each other. Each notch 62, 64, 66, has a cross-section defining two parallel sides and being semicircular where such notch 62, 64, 66, is deepest.

The chair back 70, which comprise plural boards 72 in a planar array wherein the boards 72 are spaced from one another, comprises two cleats attached via screws to the chair back 70 and extending downwardly past a lower end 74 of the chair back 70, namely a front cleat 76 attached at a front surface of the chair back 70 and a back cleat 78 at a back surface of the chair back 70, a middle cleat 80 attached at the chair back surface of the chair back 70, above the back cleat 78, and an upper cleat 82 attached at the chair back surface of the chair back 70, above the middle cleat 80.

The lower end 74 of the chair back 70, the front cleat 76, and the back cleat 78 define a slot 84 opening downwardly. An axle 90 having a circular cross-section and made from a suitable material, such as an aluminum or wooden rod or an aluminum tube, is mounted at each end 92 in a recess 94 in one of the longitudinal struts 26. The slot 84 defined by the lower end 74 of the chair back 70, the front cleat 76, and the back cleat 78 receives the axle 90, as shown in FIG. 5 and other views, whereby the chair back 70 is mounted pivotally to the chair frame 20.

Figure 6:
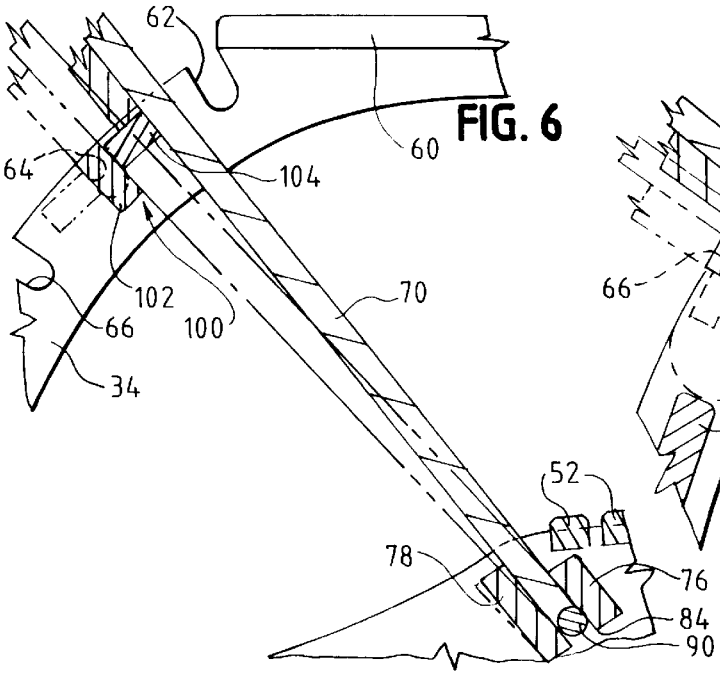
Figure 7:
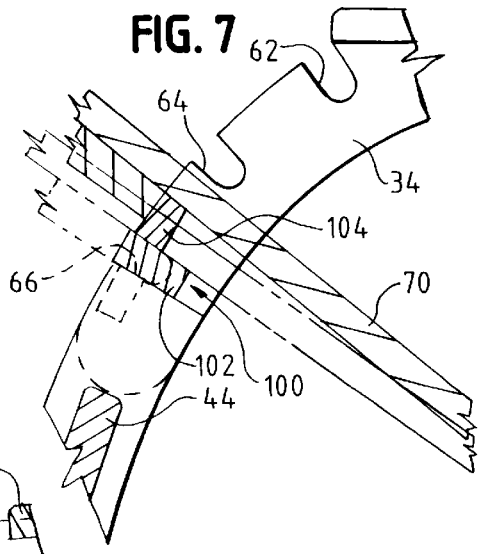

The chair 10 comprises a transverse bridge 100, which is made in two pieces attached via screws to each other, namely a transverse beam 102 and a transverse spacer 104, which is attached via screws to the transverse beam 102. The transverse beam 102, which has a rectangular cross-section, has to notches 106 opening downwardly so as to be removably and nonrotatably fittable into the upper notches 62, as shown in FIG. 5, the intermediate notches 64, as shown in FIGS. 1 and 6, or the lower notches 66, as shown in FIG. 7, so as to bridge the upper pieces 34 of the supporting legs 32. The transverse beam 102 is fittable thereinto either in an orientation wherein the transverse spacer 104 is interposed between the transverse beam 102 and the chair back 70, as shown in broken lines in FIG. 5 and in full lines in FIGS. 6 and 7, or in an orientation wherein the transverse spacer 104 is not interposed therebetween, as shown in full lines in FIGS. 1 and 5 and in broken lines in FIGS. 6 and 7. The walls of the notches 106 coact with the walls of the notches 62, 64, 66, so as to prevent transverse movement of the transverse bridge 100 relative to the chair frame 20.

Since the transverse beam 102 can be thus fitted into the upper notches 62 in two possible orientations, into the intermediate notches 64 in two possible orientations, and into the lower notches 66 in two possible orientations, the chair back 70 can be stably reclined at six reclined angles. As can be readily seen from FIGS. 5 and 6, the chair back 70 cannot be then removed because of interference between the front cleat 70 and the nearest slat 52 of the chair seat 50. As shown in FIGS. 5, 6, and 7, the upper cleat 78 overlies a portion of the transverse beam 102 so as to prevent the transverse beam 102 from lifting from the selected notches 62, 64, 66, unless the chair back 70 is tilted forwardly. The outer edges of the upper pieces of the supporting legs 32 conform to circular arcs coaxial with the axle 90.

Figure 8:
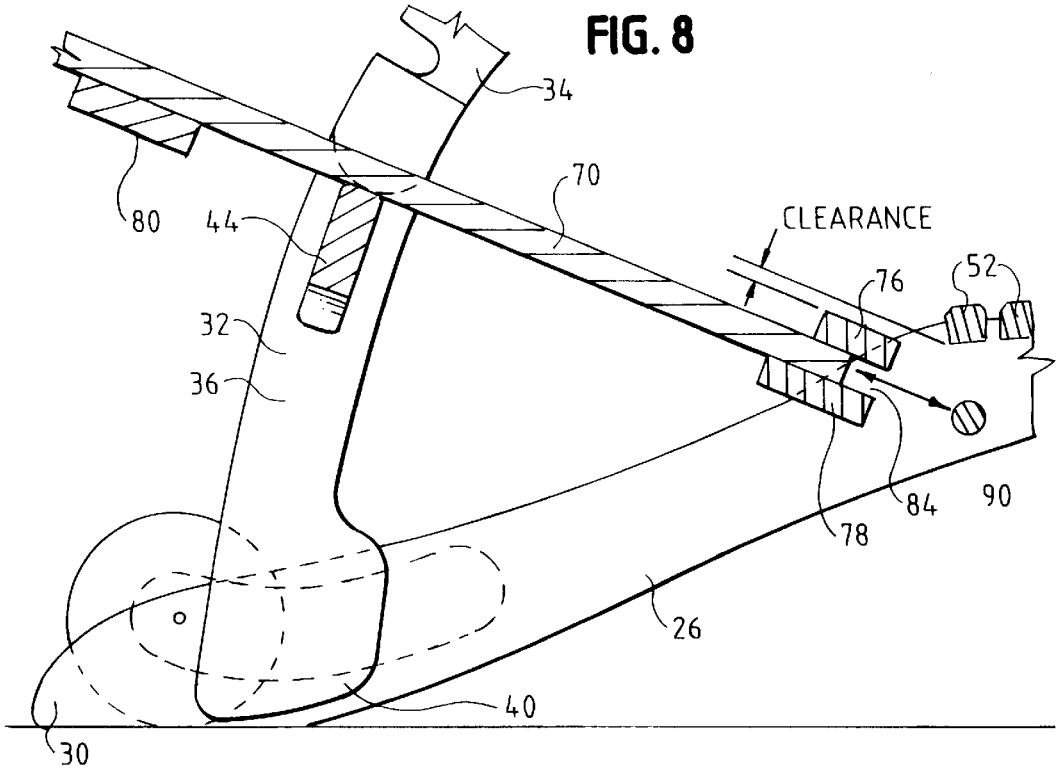
FIG. 8 is a fragmentary detail of the chair, as shown in FIG. 1 but with the chair back being removed.

If the transverse bridge 100 is removed from the chair 10, the chair back 70 can be then reclined until the chair back 70 bears backwardly and downwardly against the rigid brace 44, as shown in broken lines in FIG. 5, at a seventh reclined angle. Moreover, as shown in FIG. 8, the chair back 70 can be then removed without interference between the front cleat 76 and the nearest slat 52 of the chair seat 50. Cumulatively, therefore, the chair back 70 is reclinable at seven reclined angles.

Figure 9:
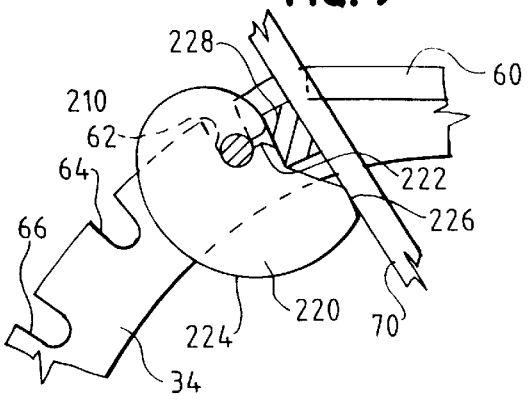
FIG. 9, 10, 11, and 12 are fragmentary details showing other contemplated embodiments of this invention.
Figure 12:
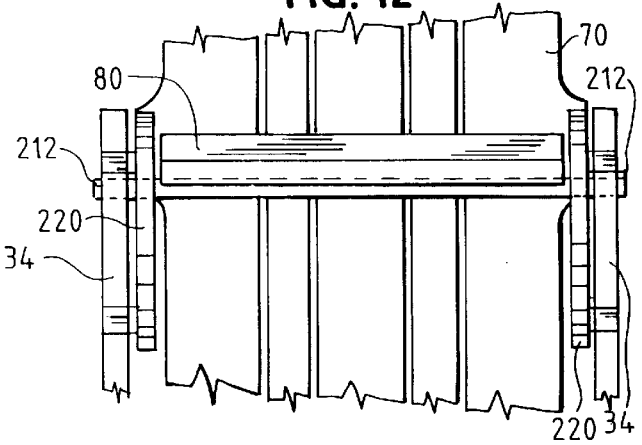

In the alternative embodiment shown in FIG. 9, the transverse bridge 100 is replaced by a transverse bridge 200, which comprises a transverse axle 210 defining an axis, having a circular cross-section, and having two opposite ends 212. The transverse axle 210 is made from a suitable material, such as an aluminum or wooden rod or an aluminum tube, and two similar spacers 220, one near each end 212. Each spacer 220 is attached via a screw 222 to the transverse axle 210 so as to be conjointly rotatable with the transverse axle 210. As shown in FIG. 12, the middle cleat 80 is shortened so as to fit between the spacers 220 without interfering with the spacers 220.

As shown in FIG. 9, each spacer 220 has a bearing surface 224 that, when viewed axially, defines a spiral. The bearing surface 224 is adapted to bear against a cleat 228, which is attached to the back surface of the chair back 70, at varying radial distances from the axis defined by the transverse axle 210. The varying radial distances correspond to varying locations on the bearing surface 224. As shown in FIG. 9, the bearing surface 224 defines a flat 226, which is adapted to bear against the chair back 70 at one such radial distance from the axis defined by the transverse axle 210.

Figure 10:
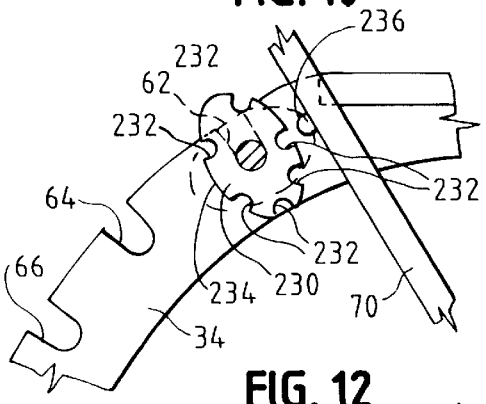

The alternative embodiment shown in FIG. 10 is similar to the alternative embodiment shown in FIG. 9, except that the spacers 220 are replaced by two spacers 230, each having a bearing surface 234. The bearing surface 234 of each spacer 230, when viewed axially, conforms generally to a closed, curved shape, such as an ellipse. Further, the bearing surface 234 of each spacer 230 has six recesses 232. A rib 236 having a semicircular profile and attached to the back surface of the chair back 70 is adapted to fit into a selected one of the recesses 232 so as to prevent slippage between the bearing surface 234 and the chair back 70.

Figure 11:
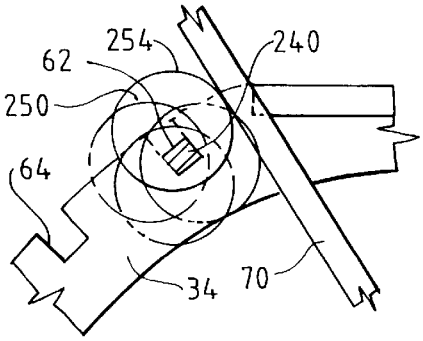

The alternative embodiment shown in FIG. 11 is similar to the alternative embodiment shown in FIG. 10, except that the transverse axle 210 is replaced by a transverse bar 240 defining an axis and having a square cross-section and except that the spacers 230 are replaced by two spacers 250, each having a bearing surface 234. The bearing surface 254 of each spacer 250, when viewed axially, is circular and is eccentric with respect to the axis defined by the transverse bar 240. The cross-sections of the notches 62, 64, 66, and of the transverse bar 240 prevent slippage between the bearing surface 254 and the chair back 70.

In the alternative embodiment shown in FIGS. 9 and 10, a knob, lever, or wheel (not shown) can be also attached to one end of the transverse axle 210 or to each end thereof, so as to facilitate rotation of the transverse axle.

All references herein to a chair are intended to refer not only to a chair allowing a user sitting in the chair to place his or her feet on the floor or ground beneath the chair but also to a chaise longue elevating the feet of the user.

Various modifications in any of the illustrated embodiments are possible without departing from the scope and spirit of this invention.

I claim:

1. A chair comprising a frame, a seat mounted fixedly to the frame, and a back having a lower end, the back being reclinable and being mounted pivotally to the frame at the lower end, behind a back edge of the seat, the frame including two bridge-supporting legs, each supporting leg extending between an upper end and a lower end behind and below the upper end of said supporting leg, each supporting leg being located on a respective side of the chair and having an opening, the chair further comprising a transverse bridge fittable removably into the openings so as to bridge the bridge-supporting legs in any one of at least two orientations of the transverse bridge, the transverse bridge being configured so as to limit pivotal movement of the back, when pivoted downwardly and backwardly, to any one of at least two reclined positions of the back, specifically to one reclined position in each said orientation of the transverse bridge, wherein the transverse bridge comprises a transverse beam, which is fittable removably and nonrotatably into the openings so as to bridge the bridge-supporting legs in either of two said orientations, and at least one spacer, which is mounted fixedly to the transverse beam, which is interposed between the transverse beam and the back in a given one of said two orientations, and which is not interposed between the transverse beam and the back in the other one of said two orientations.

2. The chair of claim 1 wherein the spacer extends along the transverse beam.

3. The chair of any one of claims 1 and 2 wherein each opening is a notch in the bridge-supporting leg having said notch and each notch opens upwardly and backwardly.

4. The chair of claim 3 wherein the notch in each supporting leg is one of plural notches in said supporting leg.

5. The chair of 3 wherein the chair further comprises a cleat, which is attached to the back and which is positioned so as to overlie a portion of the transverse bridge so as to prevent the transverse bridge from lifting from the notches in the bridge-supporting legs when the back is positioned in one of the reclined positions.

6. The chair of claim 5 wherein the notch in each supporting leg is one of plural notches in said supporting leg.

* * * * *

UNITED STATES PATENT AND TRADEMARK OFFICE

CERTIFICATE OF CORRECTION

PATENT NO. : 6,003,946
DATED : December 21, 1999
INVENTOR(S) : Andrew W. Jackson It is certified that error appears in the above-identified patent and that said Letters Patent is hereby corrected as shown below:

Title page, where the address of the inventor is printed, "Midland" should read -- Middaugh --.

Column 2,
Line 32, "FIG." should read -- FIGS. --.

Column 3,
Line 51, after "has", "to" should read -- two --;

Column 6,
Line 22, "reclined" should read -- inclined --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*